US010207384B2

(12) United States Patent
Zheng et al.

(10) Patent No.: US 10,207,384 B2
(45) Date of Patent: Feb. 19, 2019

(54) FLEXIBLE DEVICE FOR BURR REMOVING

(71) Applicant: CITIC Dicastal CO., LTD., Qinhuangdao (CN)

(72) Inventors: Yao Zheng, Qinhuangdao (CN); Jiandong Guo, Qinhuangdao (CN); Lei Yang, Qinhuangdao (CN); Xiaoguang Huang, Qinhuangdao (CN); Xuesong Wang, Qinhuangdao (CN); Huiying Liu, Qinhuangdao (CN); Zhiyuan Yu, Qinhuangdao (CN); Weimin Cai, Qinhuangdao (CN); Yongwang Zhao, Qinhuangdao (CN)

(73) Assignee: CITIC DICASTAL CO., LTD (CN)

( * ) Notice: Subject to any disclaimer, the term of this patent is extended or adjusted under 35 U.S.C. 154(b) by 127 days.

(21) Appl. No.: 15/594,532

(22) Filed: May 12, 2017

(65) Prior Publication Data

US 2018/0243876 A1 Aug. 30, 2018

(30) Foreign Application Priority Data

Feb. 24, 2017 (CN) ..... 2017 1 0103770

(51) Int. Cl.

| | |
|---|---|
| ***B24B 5/08*** | (2006.01) |
| ***B24B 5/40*** | (2006.01) |
| ***B24B 5/44*** | (2006.01) |
| ***B24B 9/04*** | (2006.01) |
| ***B24B 27/00*** | (2006.01) |
| ***B24B 29/00*** | (2006.01) |
| ***B24B 29/04*** | (2006.01) |

(52) U.S. Cl.

CPC ..... *B24B 5/44* (2013.01); *B24B 5/08* (2013.01); *B24B 5/40* (2013.01); *B24B 9/04* (2013.01); *B24B 27/0076* (2013.01); *B24B 29/005* (2013.01); *B24B 29/04* (2013.01)

(58) Field of Classification Search

CPC .. B24B 5/06; B24B 5/065; B24B 5/08; B24B 5/14; B24B 5/16; B24B 5/165; B24B 5/40; B24B 5/44; B24B 9/00; B24B 9/04; B24B 27/0076; B24B 29/005; B24B 33/02; B24B 33/025; B24B 39/023

See application file for complete search history.

(56) References Cited

U.S. PATENT DOCUMENTS 4,527,300 A * 7/1985 Kunde ..... B24B 29/04 15/88.2

5,161,281 A * 11/1992 Hanen ..... B08B 1/04 15/88.3

(Continued)

*Primary Examiner* — Timothy V Eley

(74) *Attorney, Agent, or Firm* — Weintraub Tobin; Zheng "Andy" Liu

(57) ABSTRACT

The present disclosure provides a flexible device for burr removing, which is composed of a frame (1), lower flanges (2), guide posts (3), thrust cylinders (4), guide sleeves (5), thrust shafts (6), sleeves (7), a movable plate (8), upper flanges (9), a dust guard (10), cylinder housings (11) and the like. The flexible device for burr removing in use can meet the requirement for brushing burrs on wheels having two different sizes in one burr brusher, has the characteristics of ideal effect, high efficiency, safety and reliability in work and high degree of automation, and is particularly suitable for batch production on production lines.

3 Claims, 6 Drawing Sheets

(56) References Cited

U.S. PATENT DOCUMENTS

| | | | | |
|---|---|---|---|---|
| 6,261,160 | B1 * | 7/2001 | Hakomori | B23Q 7/04 451/209 |
| 6,722,961 | B2 * | 4/2004 | Solanellas | B23Q 1/54 451/140 |
| 9,782,866 | B1 * | 10/2017 | Xue | B24B 9/04 |
| 9,833,873 | B2 * | 12/2017 | Xue | B24B 29/005 |
| 10,010,993 | B2 * | 7/2018 | Xue | B24B 9/04 |
| 10,022,834 | B2 * | 7/2018 | Xue | B24B 9/04 |
| 10,065,284 | B2 * | 9/2018 | Xue | B24B 9/04 |
| 10,112,279 | B2 * | 10/2018 | Xue | B24B 21/16 |
| 10,112,282 | B2 * | 10/2018 | Xue | B24B 5/44 |
| 2016/0184958 | A1 * | 6/2016 | Xue | B24B 29/005 451/59 |
| 2016/0353873 | A1 * | 12/2016 | Xue | A46B 13/02 |
| 2017/0182614 | A1 * | 6/2017 | Xue | B24B 9/04 |
| 2017/0182615 | A1 * | 6/2017 | Xue | B24B 9/04 |
| 2017/0182619 | A1 * | 6/2017 | Xue | B24B 9/04 |
| 2017/0182620 | A1 * | 6/2017 | Xue | B24B 9/04 |
| 2017/0209976 | A1 * | 7/2017 | Xue | B24B 21/16 |
| 2017/0348816 | A1 * | 12/2017 | Xue | B24B 5/44 |
| 2017/0348817 | A1 * | 12/2017 | Xue | B24B 5/44 |
| 2018/0001436 | A1 * | 1/2018 | Xue | B24B 5/44 |
| 2018/0085882 | A1 * | 3/2018 | Xue | B24B 5/44 |
| 2018/0085886 | A1 * | 3/2018 | Xue | B24B 29/005 |
| 2018/0085887 | A1 * | 3/2018 | Xue | B24B 29/04 |
| 2018/0147685 | A1 * | 5/2018 | Xue | B24B 5/44 |
| 2018/0264616 | A1 * | 9/2018 | Xue | B24B 27/0023 |
| 2018/0264617 | A1 * | 9/2018 | Xue | B24B 27/0076 |

* cited by examiner

FLEXIBLE DEVICE FOR BURR REMOVING

RELATED APPLICATION

This application claims priority to Chinese Patent Application No. 201710103770.2, filed on Feb. 24, 2017, which is hereby incorporated by reference in its entirety.

TECHNICAL FIELD

The present disclosure relates to a flexible device for burr removing, and specifically to a device capable of removing burrs on back cavities of wheels having different sizes.

BACKGROUND

For automobile wheel machining enterprises, burrs produced on wheels need to be removed after machining. The existing wheel burr brushers are single in function, one burr brusher can only brush burrs on back cavities of wheels having one size, and the working pressure of brushing burrs on the back cavities of the wheels after machining is increased with the improvement on automation degree of production lines.

SUMMARY

One of the technical advantages provided by the embodiments described in the present disclosure includes providing a flexible device for burr removing.

In order to achieve the above object, the present disclosure adopts the technical solution: a flexible device for burr removing is composed of a frame, lower flanges, guide posts, thrust cylinders, guide sleeves, thrust shafts, sleeves, a movable plate, upper flanges, a dust guard, cylinder housings, pins I, spacer rings I, cylinders, connectors, pins II, clamping springs, brushes, a brace, pressure blocks, pins III, spacer rings II, a coupling and a motor.

The dust guard is arranged on the frame, the lower flanges and the upper flanges are respectively fixed on the frame and the dust guard, the guide posts are fixed on the lower flanges and the upper flanges, the guide sleeves are fixed on the movable plate via the guide posts, the thrust cylinders are fixed on the frame, the thrust shafts are in threaded connection with the thrust cylinders and fixed on the sleeves, the housings are fixed on the frame, the cylinders are fixed on the housings via the pins I and the spacer rings I, cylinder rods are connected with the connectors together via the pins II and the clamping springs, the pressure blocks are connected with the spacer rings II together via the pins II and the pins III and can rotate, the brushes are fixed on the brace, the brace is connected with the motor together via the coupling, and the motor is fixed with the movable plate together via bolts.

When a large-sized wheel is put on the frame, the cylinders drive the connectors to move in a plane via the pins I and the pins II, the pressure blocks connected with the pins II move circumferentially by using the pins III as centers, and a synchronous clasping and centering function on the large-sized wheel is thus realized.

When a small-sized wheel is put on the frame, the cylinders drive the connectors to move right, the pressure blocks move circumferentially by using the pins III as centers, and a synchronous clasping and centering function on the small-sized wheel is finally realized.

The cylinder rods of the thrust cylinders push the movable plate to move linearly, the movable plate pushes the motor, and thus the brushes move up and down. An output shaft of the motor drives the brace to move circumferentially via the coupling, the brace is connected with the brushes via bolts, and the brushes finally rotate in the circumferential direction to brush the wheel.

In practical use, a manipulator puts a wheel on the floor of the frame, compressed air is introduced into the cylinders, the pressure blocks press the hub to realize centering and positioning of the wheel, then the thrust cylinders push the movable plate up via the thrust shafts, the motor drives the brushes to rotate circumferentially via the coupling and the brace, and the function of brushing burrs on the wheel is thus realized.

The flexible device for burr removing of the present disclosure in use can meet the requirement for brushing burrs on wheels having two different sizes in one burr brusher, has the characteristics of ideal effect, high efficiency, safety and reliability in work and high degree of automation, and is particularly suitable for batch production on production lines.

Figure 1:
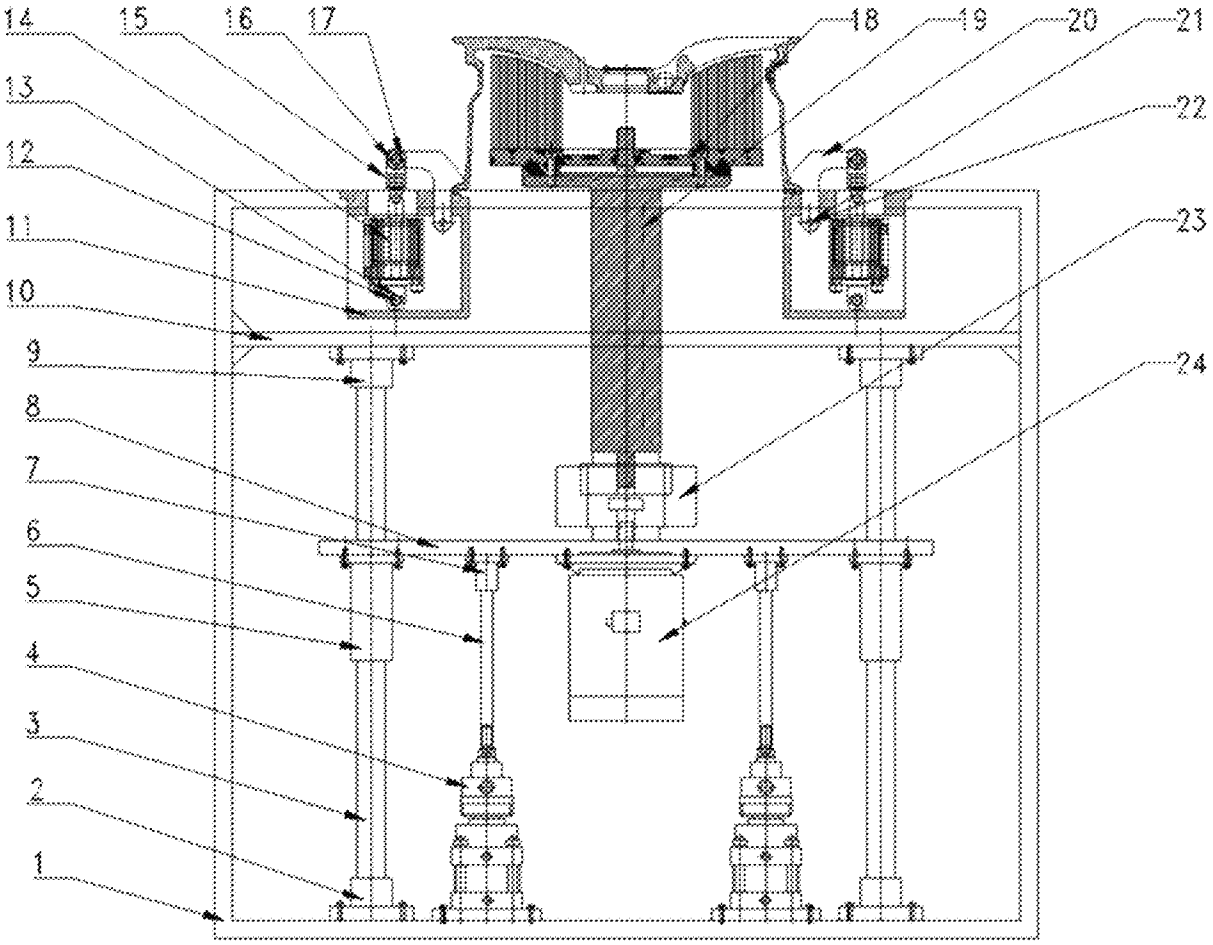
FIG. 1 is a structural schematic diagram when a flexible device for burr removing of the present disclosure works.

In which: 1—frame, 2—lower flange, 3—guide post, 4—thrust cylinder, 5—guide sleeve, 6—thrust shaft, 7—sleeve, 8—movable plate, 9—upper flange, 10—dust guard, 11—cylinder housing, 12—pin I, 13—spacer ring I, 14—cylinder, 15—connector, 16—pin II, 17—clamping spring, 18—brush, 19—brace, 20—pressure block, 21—pin III, 22—spacer ring II, 23—coupling, 24—motor.

DETAILED DESCRIPTION OF THE EMBODIMENTS

A robot gripper includes a bottom plate 101, a side plate A 102, an intermediate plate 103, a side plate B 104, guide rods 105, sliding blocks 106, cylinders 107, spherical joints 108, pneumatic quick plug connectors, a connecting plate 114, racks 115, a gear 116, a gear shaft 117, a horn type switch support 120, detection switches 121 and a detection head 122.

FIG. 1 shows a front view of the shield-free robot gripper of the present disclosure.

The bottom plate 101 is connected with the intermediate plate 103, the side plate A 102 and the side plate B 104 together by bolts. The intermediate plate 103 is provided with four circular through holes, four guide rods 105 penetrate through the four circular through holes of the intermediate plate 103, and the two ends of the guide rods 105 are respectively connected with the side plate A 102 and the side plate B 104 by bolts, thus forming a basic framework of the gripper.

A left cylinder 107 and a right cylinder 107 are connected with the side plate A 102 and the side plate B 104 respectively, cylinder heads of the cylinders 107 are connected with the two sliding blocks 106 via the spherical joints 108, the guide rods 105 penetrate through the sliding blocks 106 with circular through holes, and the sliding blocks 106 can slide freely along the guide rods 105. The connecting plate 114 is fixed on the sliding blocks 106, and extraction and retraction of piston rods of the cylinders 107 drive the sliding blocks 106 to move left and right, thus realizing opening and closing of the gripper. A gripper arm of the robot gripper of the present disclosure can be designed to connect the connecting plate 114 to grip a hub according to different demands.

Figure 2:
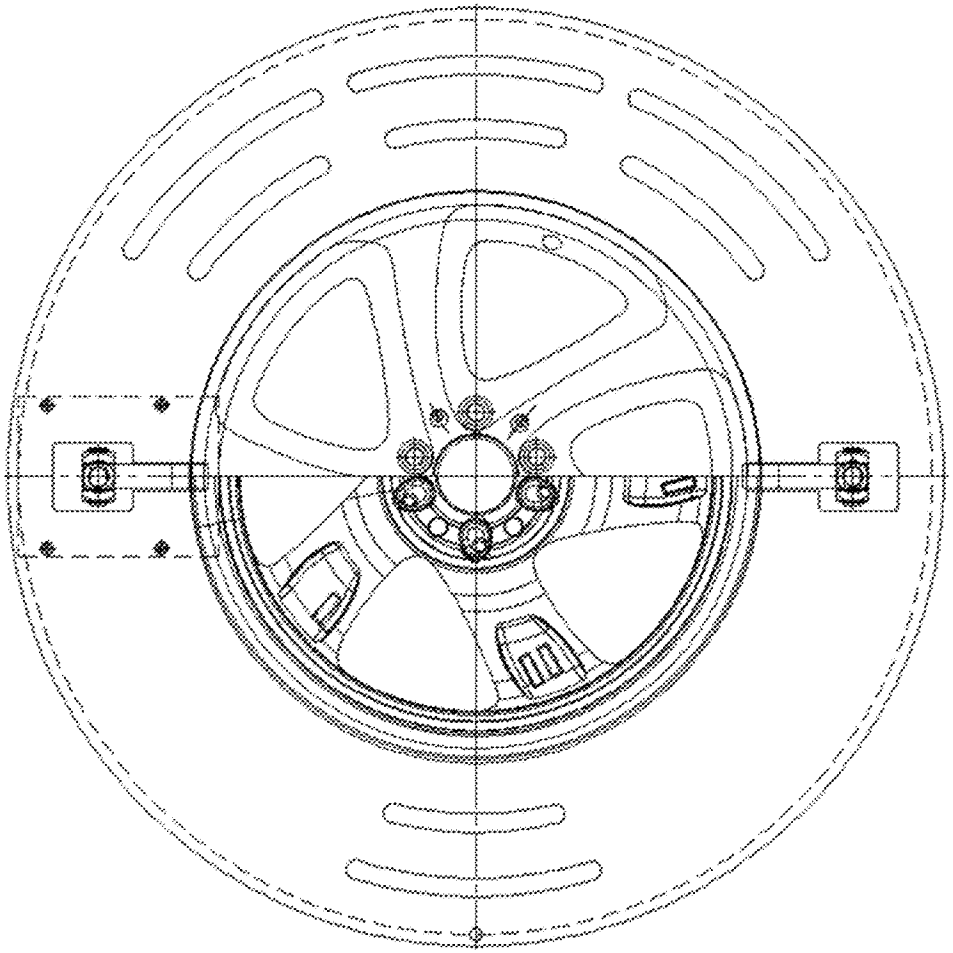
FIG. 2 is a bottom view when the flexible device for burr removing of the present disclosure works.
Figure 3:
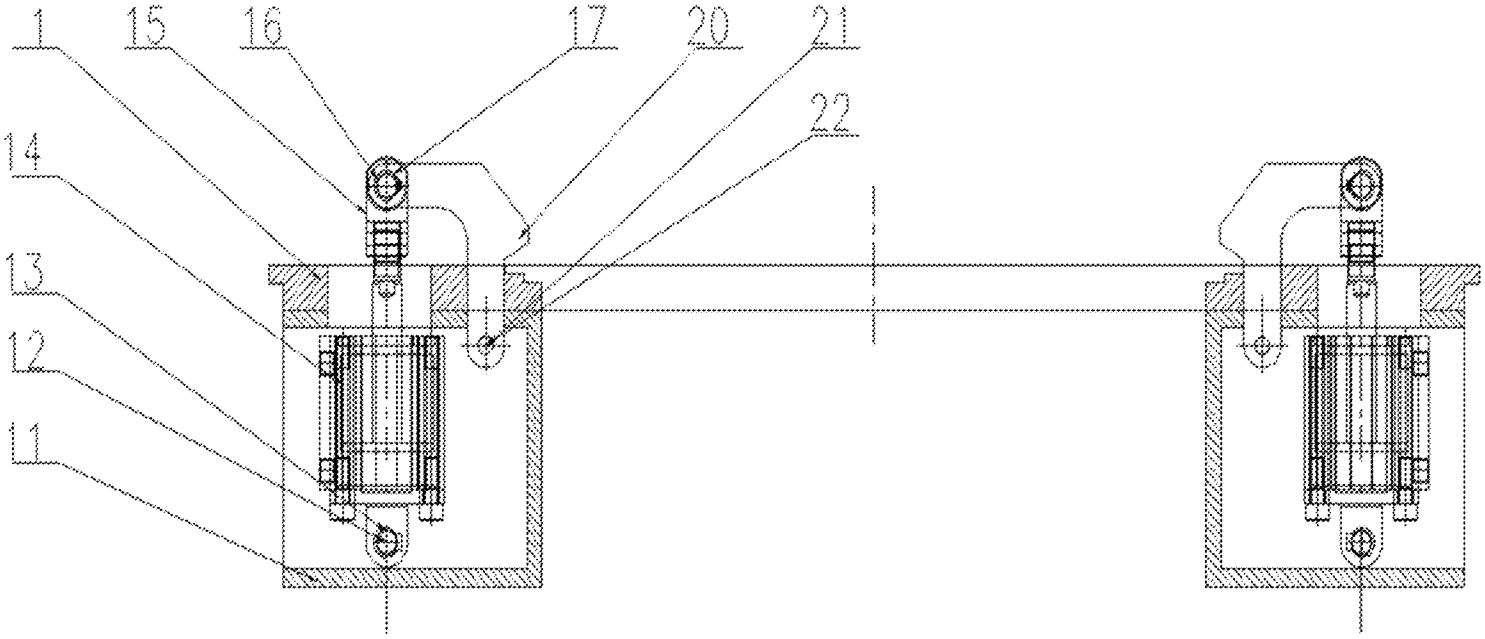
FIG. 3 is a schematic diagram of a clamp of the flexible device for burr removing of the present disclosure.

As shown in FIGS. 2 and 3, two racks 115 are connected with the two sliding blocks 106 respectively, the racks 115 can move in grooves of the bottom plate 101, the gear shaft 117 is fixed on the bottom plate 101, the gear 116 can rotate around the gear shaft 117, and the two sliding blocks 106 move synchronously via engagement transmission of the racks 115 and the gear 116, thus ensuring the repeat precision of the gripper.

Figure 4:
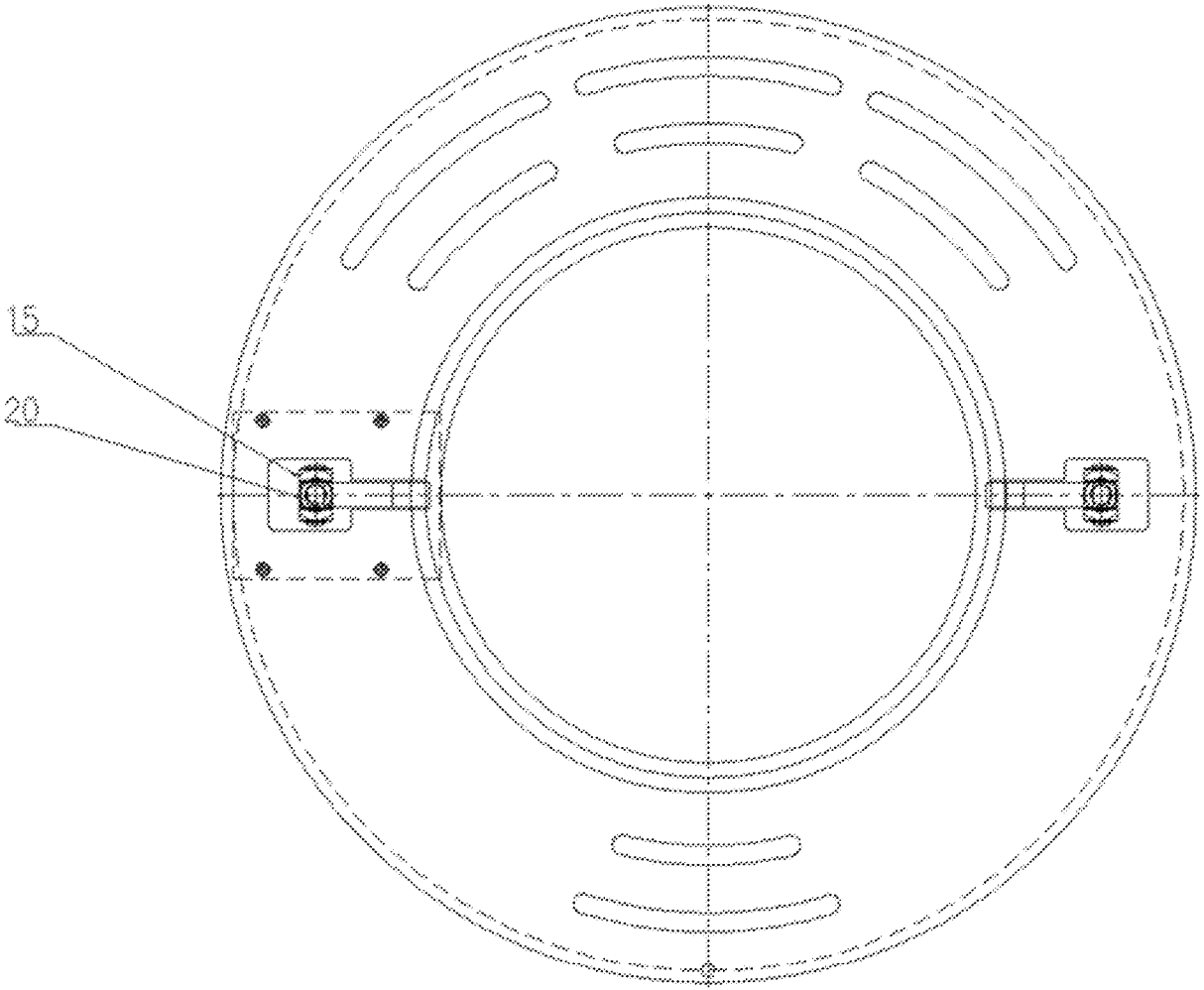
FIG. 4 is a top view of the clamp of the flexible device for burr removing of the present disclosure.
Figure 5:
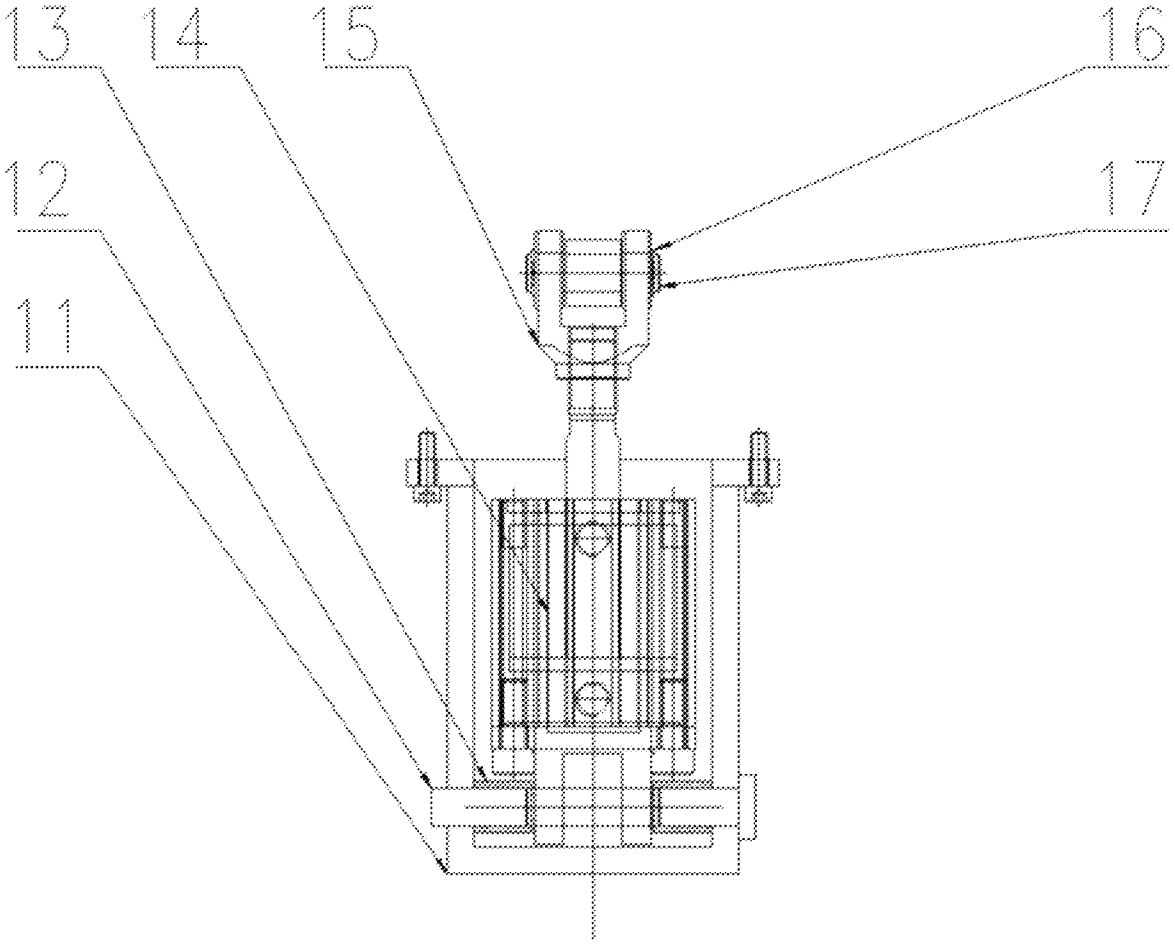
FIG. 5 is a schematic diagram of a compaction mechanism of the flexible device for burr removing of the present disclosure.

As shown in FIGS. 4 and 5, a pneumatic quick plug connector D 112 and a pneumatic quick plug connector E 113 are fixed on the intermediate plate 103; a pneumatic quick plug connector F 118 and a pneumatic quick plug connector G 119 are fixed on the intermediate plate 103; the pneumatic quick plug connector D 112 is connected with the pneumatic quick plug connector G 119 via an air hole of the intermediate plate 103; and the pneumatic quick plug connector E 113 is connected with the pneumatic quick plug connector F 118 via the air hole of the intermediate plate 103.

A pneumatic quick plug connector A 109 is fixed on the side plate 102, and a pneumatic quick plug connector B 110 and a pneumatic quick plug connector C 111 are fixed on the cylinder 107.

The pneumatic quick plug connector C 111, the pneumatic quick plug connector A 109 and the pneumatic quick plug connector D 112 are connected by an air pipe; the pneumatic quick plug connector B 110 and the pneumatic quick plug connector E 113 are connected by the air pipe.

Compressed air drives opening and closing of the gripper via the pneumatic quick plug connector F 118 and the pneumatic quick plug connector G 119 at the outer part of the gripper.

Figure 6:
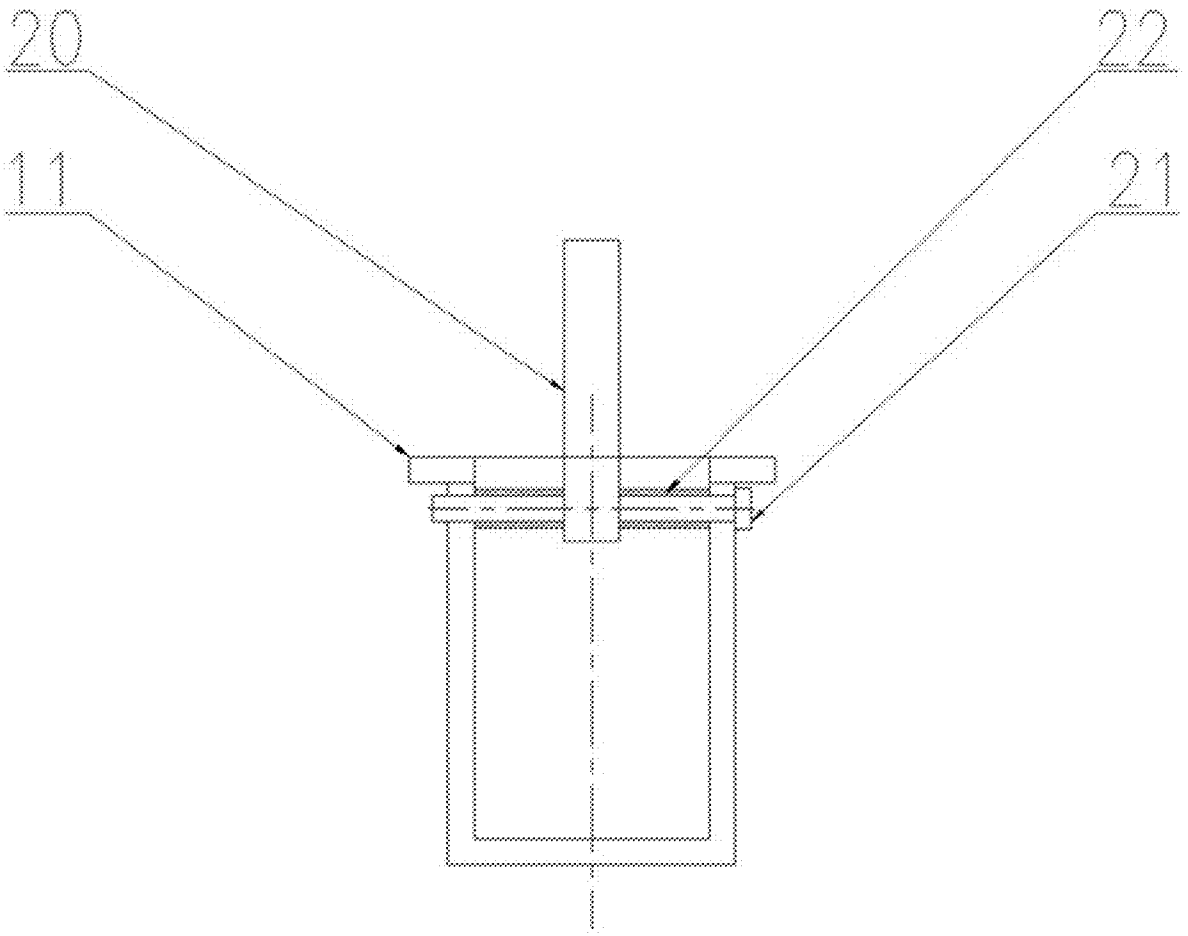
FIG. 6 is a side view of the compaction mechanism of the flexible device for burr removing of the present disclosure.

As shown in FIGS. 6 and 7, the horn type switch support 120 is fixed on the intermediate plate 103 and the side plate 102; the two detection switches 121 are fixed on the switch support 120, and the detection head 122 is fixed on the connecting plate 114.

The connecting plate 114 can drive the detection head 122 to move, and the two detection switches 121 can detect the opening and closing state of the gripper under the control of an electrical appliance.

By adopting the robot gripper, the bottom plate 101 can be connected with six-shaft flanges of a robot together by connectors; the gripper arm can be designed to connect the connecting plate 114 to grip a hub according to different demands; and the opening and closing state of the gripper can be detected by the detection switches 121.

The gripper has the advantages of low price, compact overall structure, large clamping force, strong stability and the like, and is an indispensable component on an automatic production line for aluminum alloy hubs.

The invention claimed is:

1. A flexible device for burr removing is composed of a frame (1), lower flanges (2), guide posts (3), thrust cylinders (4), guide sleeves (5), thrust shafts (6), sleeves (7), a movable plate (8), upper flanges (9), a dust guard (10), cylinder housings (11), pins I (12), spacer rings I (13), cylinders (14), connectors (15), pins II (16), clamping springs (17), brushes (18), a brace (19), pressure blocks (20), pins III (21), spacer rings II (22), a coupling (23) and a motor (24), wherein the dust guard (10) is welded on the frame (1), the lower flanges (2) and the upper flanges (9) are respectively fixed on the frame (1) and the dust guard (10), the guide posts (3) are fixed on the lower flanges (2) and the upper flanges (9), the guide sleeves (5) are fixed on the movable plate (8) via the guide posts (3), the thrust cylinders (4) are fixed on the frame (1), the thrust shafts (6) are in threaded connection with the thrust cylinders (4) and are fixed on the sleeves (7), the housings (11) are fixed on the frame (1), the cylinders (14) are fixed on the housings (11) via the pins I and the spacer rings 1(13), cylinder rods (14) are connected with the connectors (15) together via the pins II (16) and the clamping springs (17), the pressure blocks (20) are connected with the spacer rings II (22) together via the pins II (16) and the pins III (21) and can rotate, the brushes (18) are fixed on the brace (19), the brace (19) is connected with the motor (24) together via the coupling (23), and the motor (24) is fixed with the movable plate (8) together via bolts.

2. The flexible device for burr removing of claim 1, wherein when a large-sized wheel is put on the frame (1), the cylinders (14) are connected with and drive the connectors (15) to move in a plane via the pins I (12) and the pins II (16), and the pressure blocks (20) connected with the pins II (16) move circumferentially by using the pins III (21) as centers.

3. The flexible device for burr removing of claim 2, wherein when a small-sized wheel is put on the frame (1), the cylinders (14) drive the connectors (15) to move towards a direction that is to the right of the connectors, and the pressure blocks (20) move circumferentially by using the pins III (21) as centers.

* * * * *